US006983861B2

(12) United States Patent
Lin et al.

(10) Patent No.: US 6,983,861 B2
(45) **Date of Patent: *Jan. 10, 2006**

(54) DISPENSING APPARATUS

(75) Inventors: Chien-Fu Lin, Taichung (TW); Chi-Yang Liao, Taichung (TW); Gino Lu, Taichung (TW)

(73) Assignee: Aidox Technology Corporation, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/925,949

(22) Filed: Aug. 26, 2004

(65) Prior Publication Data

US 2005/0029289 A1 Feb. 10, 2005

Related U.S. Application Data

(63) Continuation-in-part of application No. 10/287,649, filed on Nov. 5, 2002, and a continuation-in-part of application No. 10/449,401, filed on Jun. 2, 2003.

(51) Int. Cl.
*B67D 5/00* (2006.01)

(52) U.S. Cl. ..... 222/83; 222/556

(58) Field of Classification Search ..... 222/81, 222/83, 83.5, 88, 90, 556
See application file for complete search history.

(56) References Cited

U.S. PATENT DOCUMENTS

| | | | | | |
|---|---|---|---|---|---|
| 547,370 | A | | 10/1895 | Chalefou | |
| 1,044,560 | A | * | 11/1912 | Morgan et al. | 222/90 |
| 1,475,988 | A | * | 12/1923 | Dieu | 222/90 |
| 3,927,803 | A | * | 12/1975 | Weber | 222/91 |
| 4,318,497 | A | * | 3/1982 | Friedrich | 222/83 |
| 4,417,672 | A | | 11/1983 | Eppenbach | |
| 4,475,914 | A | * | 10/1984 | Portnoff | 222/83 |
| 4,562,940 | A | * | 1/1986 | Asphar | 222/88 |
| D285,055 | S | * | 8/1986 | Heubel | D9/434 |
| 4,712,714 | A | * | 12/1987 | Mucciarone | 222/91 |
| 5,147,070 | A | | 9/1992 | Iwamoto | |
| 5,249,708 | A | * | 10/1993 | Magness | 222/83 |
| 5,482,176 | A | | 1/1996 | Maietta et al. | |
| 5,855,223 | A | * | 1/1999 | Halonen | 137/318 |
| 5,884,810 | A | | 3/1999 | Vizcarra et al. | |
| 5,960,992 | A | | 10/1999 | Bernstein et al. | |
| 6,202,716 | B1 | | 3/2001 | Schwartc | |
| 6,422,412 | B1 | | 7/2002 | Sagawa | |
| 2004/0238563 | A1 | * | 12/2004 | Lin | 222/81 |
| 2005/0028289 | A1 | * | 2/2005 | Lin et al. | 222/83 |

* cited by examiner

*Primary Examiner*—Kenneth Bomberg
(74) *Attorney, Agent, or Firm*—Rosenberg, Klein & Lee

(57) ABSTRACT

A spout and opener includes an opener portion with a sharp tip for opening a pack. The opener portion gets thicker and thicker from the sharp tip in order to fit into the pack tighter and tighter. The spout receives liquid from the pack. The spout portion directs the liquid to the exterior of the pack from the opener portion. The stop extends between the spout portion and the opener portion for avoiding insertion of the whole spout and opener into the pack.

11 Claims, 9 Drawing Sheets

DISPENSING APPARATUS

CROSS-REFERENCE

This application is a continuation-in-part application of U.S. patent application Ser. Nos. 10/287649 filed Nov. 5, 2002 and 10/449401 filed Jun. 2, 2003, both pending.

FIELD OF INVENTION

The present invention relates to a beverage pack and, more particularly, to a dispensing apparatus for a beverage pack.

BACKGROUND OF INVENTION

Beverage is contained in various containers such as bottles, cans and packs. Such a pack is typically made of a laminate. The laminate includes a paperboard and an aluminum foil coated on the paperboard.

In a design, no weak point is provided in the pack. A corner must be cut from the pack so as to define an orifice through which drink can be poured. A pair of scissors or a knife is necessary for getting drink from the pack.

In another design, an orifice is punched in the paperboard during production of the pack. A straw with a sharp point is inserted through the orifice in order to pierce the aluminum foil. Thus, drink can be sucked from the pack through the straw. However, this design is not convenient for two persons wanting to share a beverage pack.

U.S. Pat. No. 54,7370 discloses a detachable spout and can opener including a hollow body B with a sharp point d. The body B includes four walls a. Above a line 1—1, the walls a are constantly wide. Below the line 1—1, the walls a converge to the sharp point d. A ridge f is formed on each wall a. An opening g is defined in each wall a. A pack can be pierced by means of the sharp point d. Beverage can flow through the openings g. Complete opener portion of the body B into the pack is prevented by means of the ribs f. However, the body B tends to slack and fall from the pack since the walls a are equally wide above the line 1—1. The body B can be closed by means of a cap (not numbered). Once removed from the body B, the cap can be lost easily since it is an independent element.

The applicant's co-pending U.S. patent application Ser. No. 10/287649 filed on Nov. 5, 2002 discloses a dispensing apparatus. The dispensing apparatus cannot keep beverage in a pack once it is inserted into the pack.

The applicant's co-pending U.S. patent application Ser. No. 10/449401 filed on Jun. 2, 2003 discloses a dispensing apparatus including a spout and opener 10 and a cover 30 pivotally connected with the spout and opener 10. The spout and opener 10 can be closed by means of the cover 30.

The present invention is therefore intended to obviate or at least alleviate the problems encountered in prior art.

SUMMARY OF INVENTION

According to the present invention, a spout and opener includes an opener portion with a sharp tip for opening a pack. The opener portion gets thicker and thicker from the sharp tip in order to fit into the pack tighter and tighter. The spout receives liquid from the pack. The spout portion directs the liquid to the exterior of the pack from the opener portion. The stop extends between the spout portion and the opener portion for avoiding insertion of the whole spout and opener into the pack.

The primary advantage of the dispensing apparatus of the present invention is the opener portion getting thicker from the sharp tip in order to fit tighter into the pack.

Other objects, advantages, and novel features of the invention will become more apparent from the following detailed description when taken in conjunction with the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
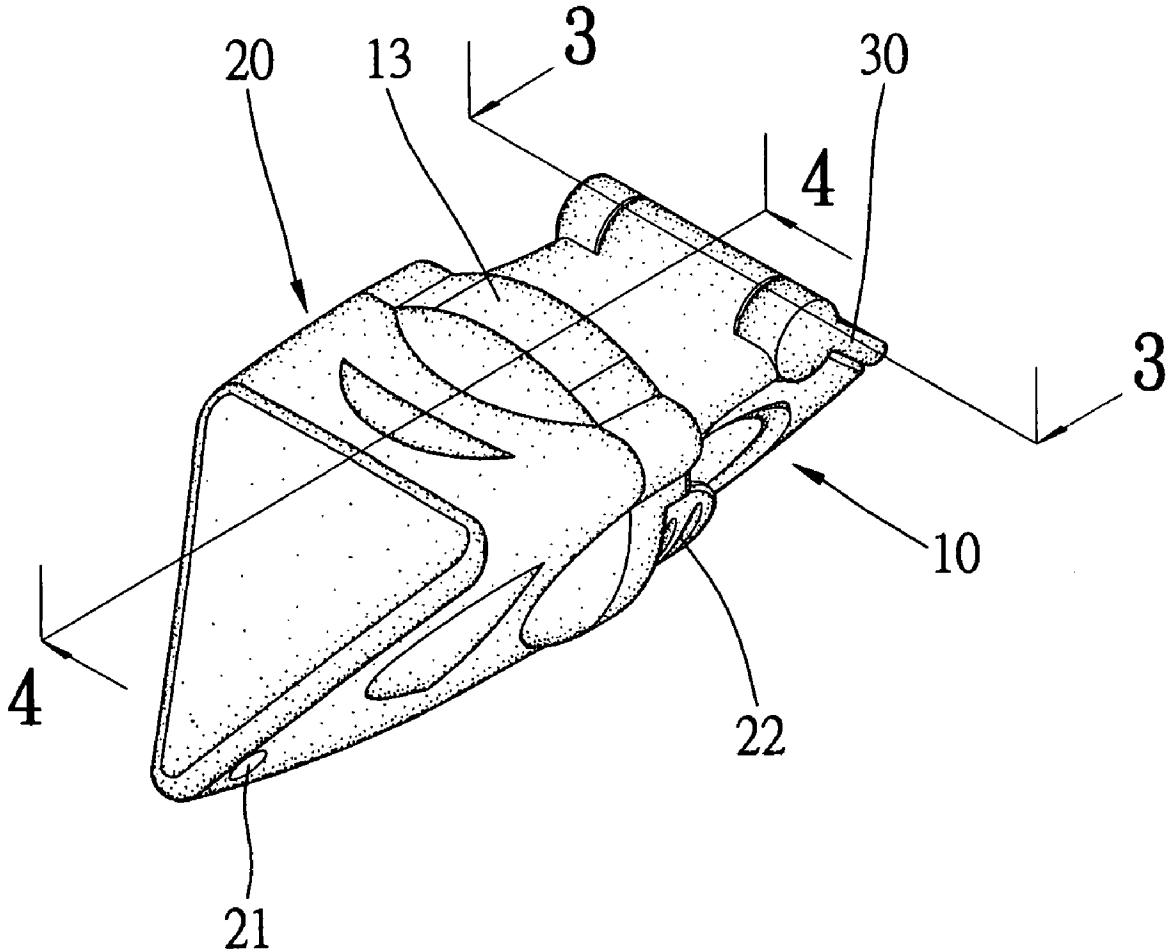
FIG. 1 is a perspective view of a dispensing apparatus according to the preferred embodiment of the present invention.

FIGS. 1~4 show a dispensing apparatus according to the preferred embodiment of the present invention. Referring to FIG. 1, the dispensing apparatus includes a spout and opener 10, a cap 20 and a cover 30.

Figure 2:
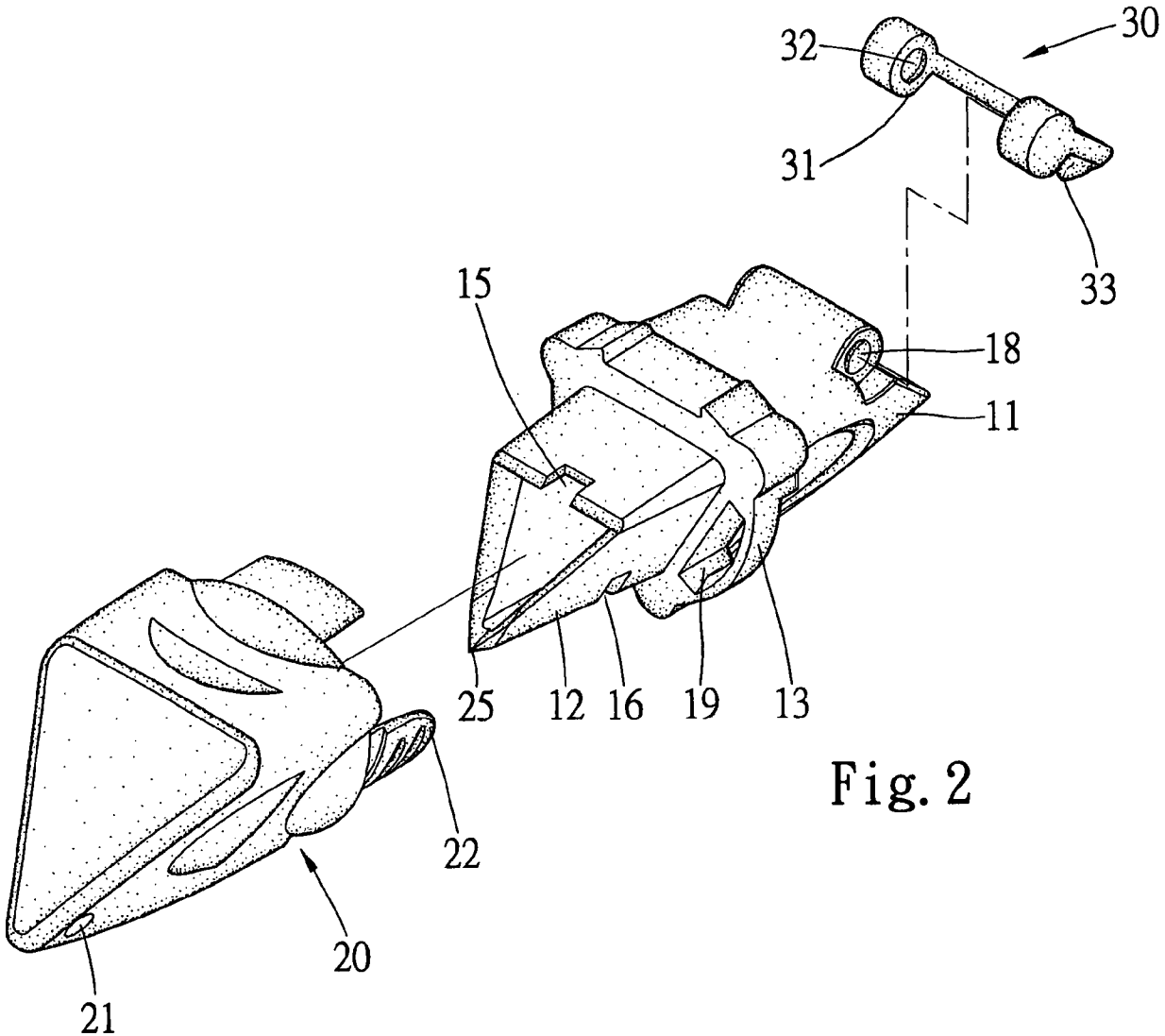
FIG. 2 is an exploded view of the dispensing apparatus of FIG. 1.

Referring to FIG. 2, the spout and opener 10 defines a passage 14. The spout and opener 10 includes a spout portion 11, an opener portion 12 and a stop 13 between the spout portion 11 and the opener portion 12. A cutout 15 is defined in an edge of the opener portion 12. A slot 16 is defined in the opener portion 12. A ridge 17 is formed on the spout portion 11. Two recesses 18 are defined in the spout portion 11. A slot 19 is defined in the stop 13.

The cap 20 defines an aperture 21 through which a ring (not shown) can be inserted. Thus, the dispensing apparatus can be hung on a proper external article. The cap 20 includes a tab 22 extending from an edge thereof. The tab 22 is inserted into the slot 19 when the cap 20 covers the opener portion 12.

The cover 30 is pivotally attached to the spout portion 11. The cover 30 includes two ears 31 formed thereon, a boss 32 formed on each of the ears 31 and a hook 33 formed thereon.

Figure 3:
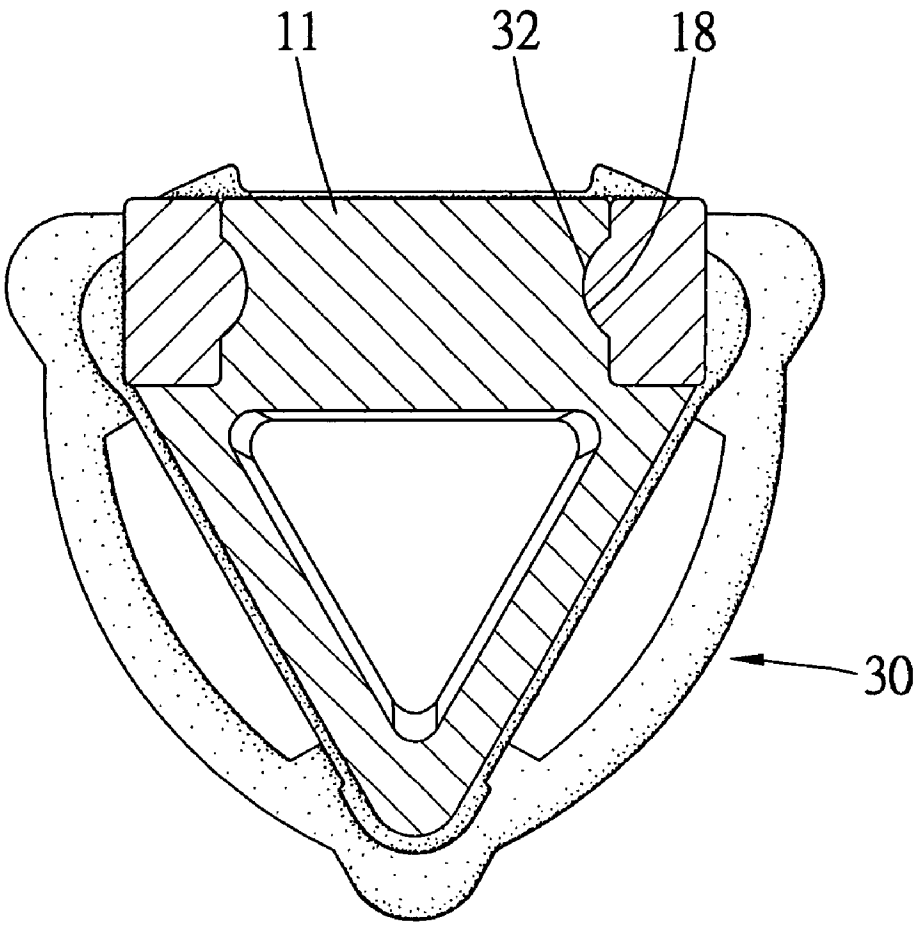
FIG. 3 is a cross-sectional view taken along a line 3—3 in FIG. 1.
Figure 4:
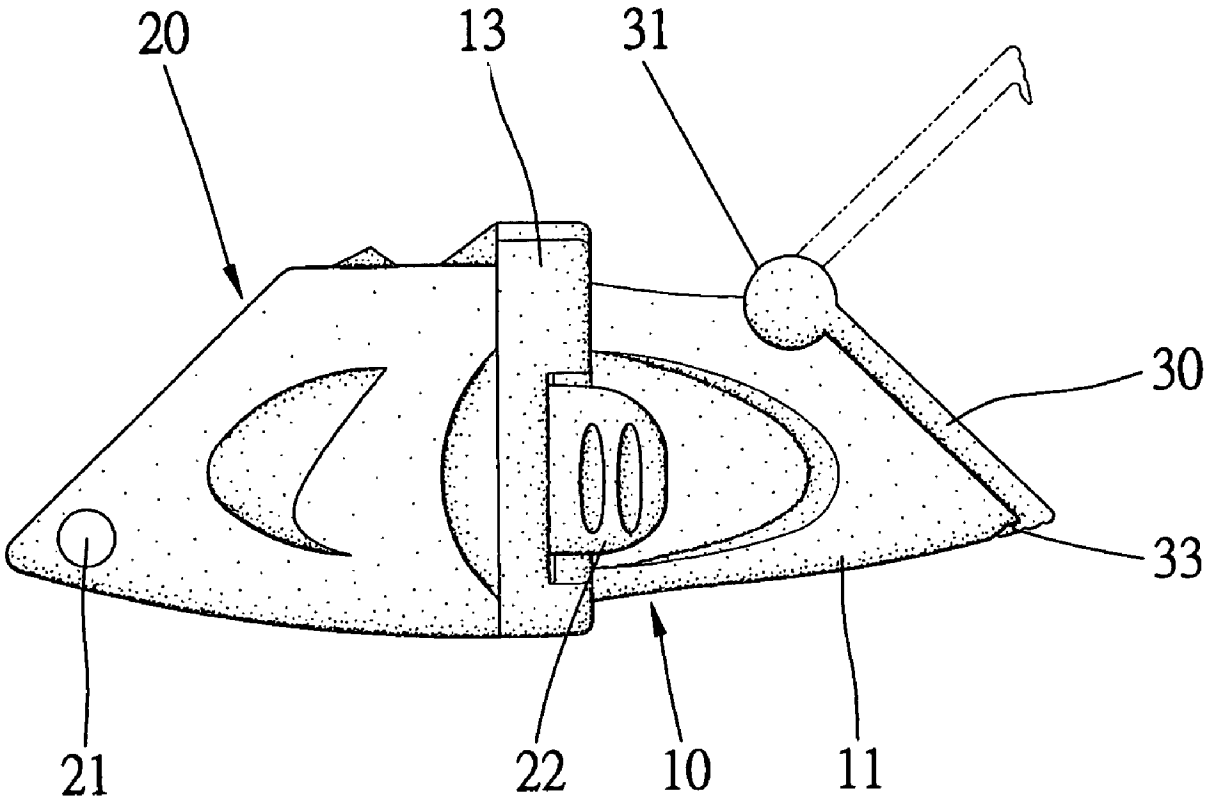
FIG. 4 is a side view taken along a line 4—4 in FIG. 1.

Referring to FIG. 3, the bosses 18 are put in the recesses 32. Referring to FIG. 4, the cover 30 can thus be pivoted between a covering position and an opening position on the spout portion 11. In the covering position of the cover 30, the buck 33 holds on to the spout portion 11.

Figure 5:
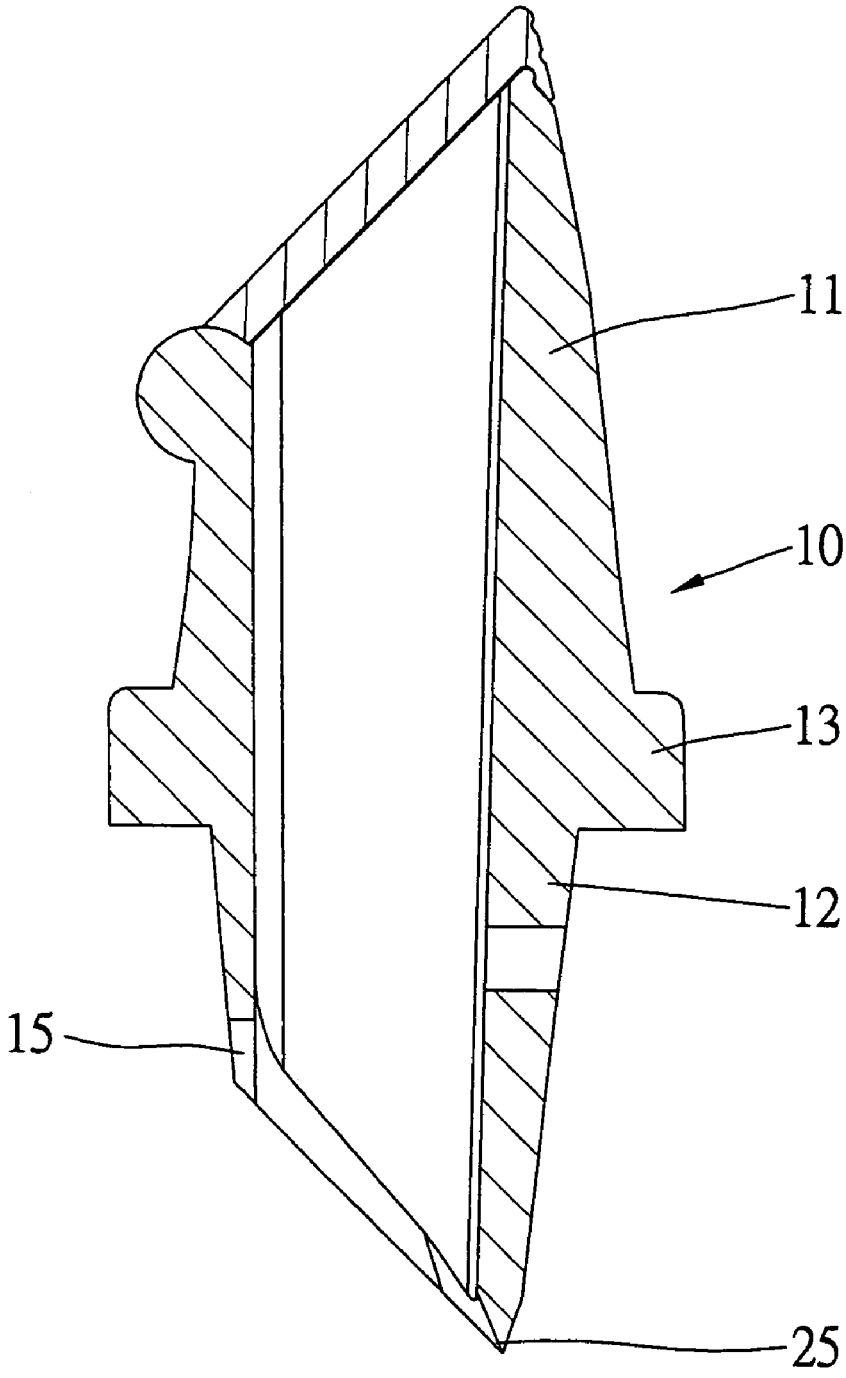
FIG. 5 is a cross-sectional view of a spout and opener of the dispensing apparatus of FIG. 1.
Figure 7:
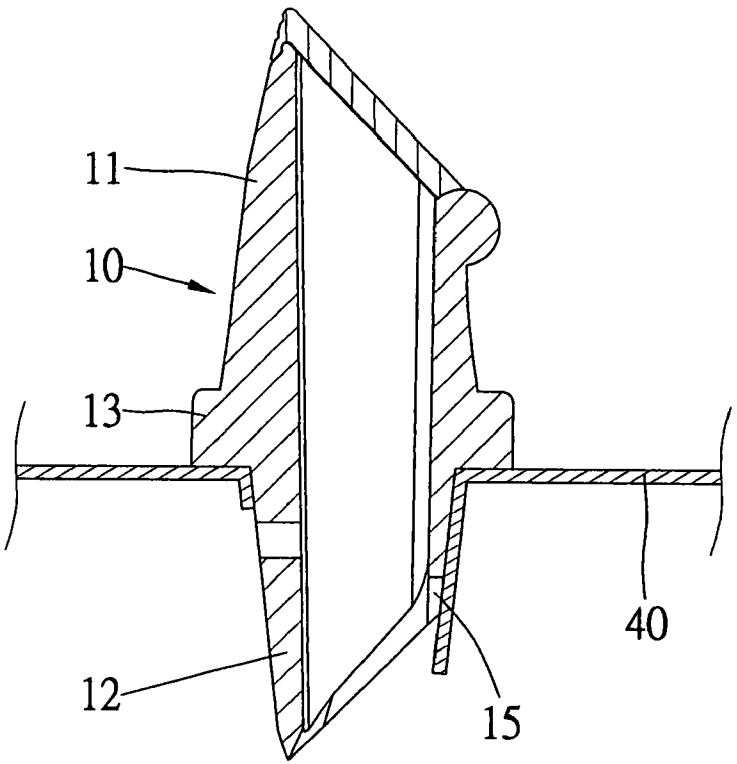
FIGS. 6 and 7 are cross-sectional views of a beverage pack opened by means of the spout and opener shown in FIG. 5.
Figure 6:
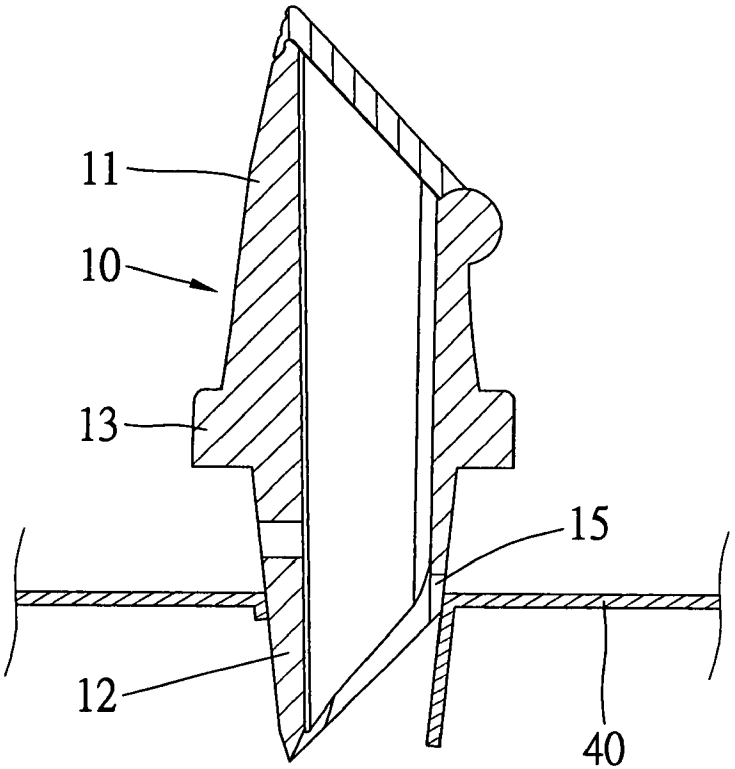

Referring to FIG. 5, the opener portion 12 becomes thicker from a sharp tip 25 to the stop 13. When the opener portion 12 is inserted in a pack 40 (FIGS. 6 and 7), the increasing dimension of the opener portion 12 makes the opener portion 12 fit tighter in the pack 40. The stop 13 can abut against the pack 40 in order to prevent insertion of the whole spout and opener 10 into the pack 40.

Figure 8:
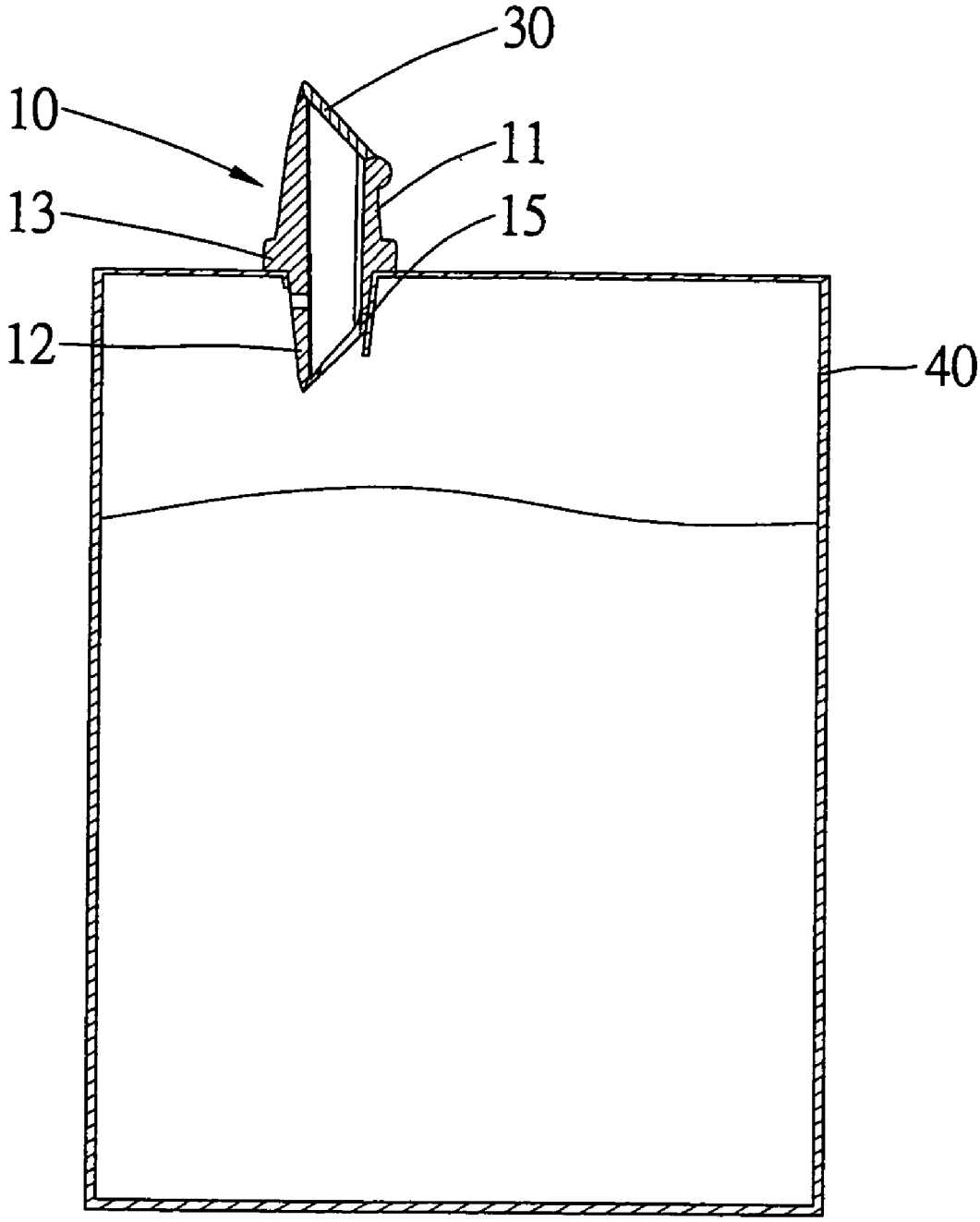
FIGS. 8 through 10 are reduced cross-sectional views of the beverage pack and the spout and opener shown in FIG. 6 in different positions.

Referring to FIG. 8, the opener portion 12 is tightly inserted in the pack 40. The cover 30 is in the covering position. Thus, beverage is kept in the pack 40.

Figure 9:
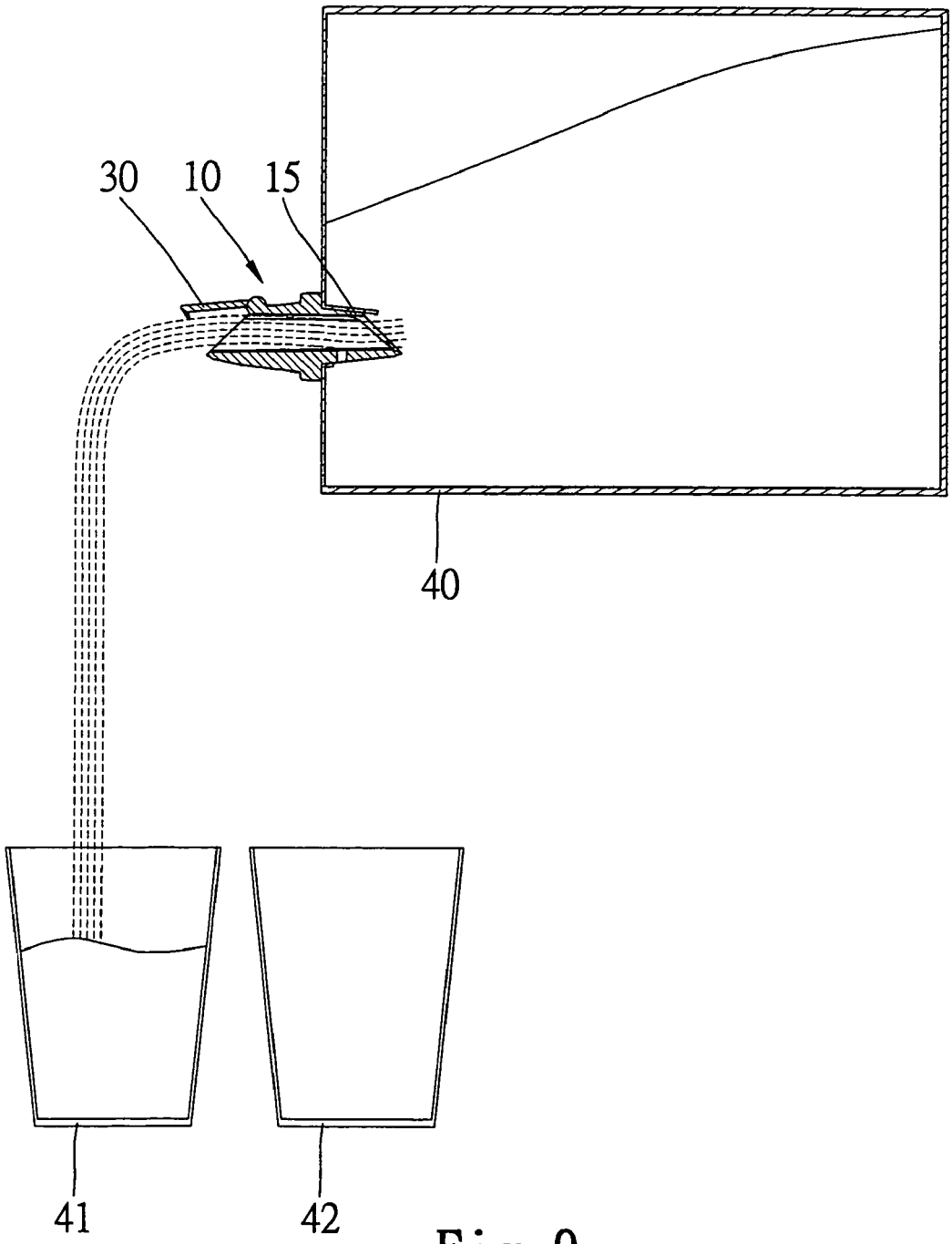

Referring to FIG. 9, the cover 30 is in the covering position. The pack 40 is tilted so that the beverage is poured into a cup 41 from the pack 40 through the spout and opener 10.

Figure 10:
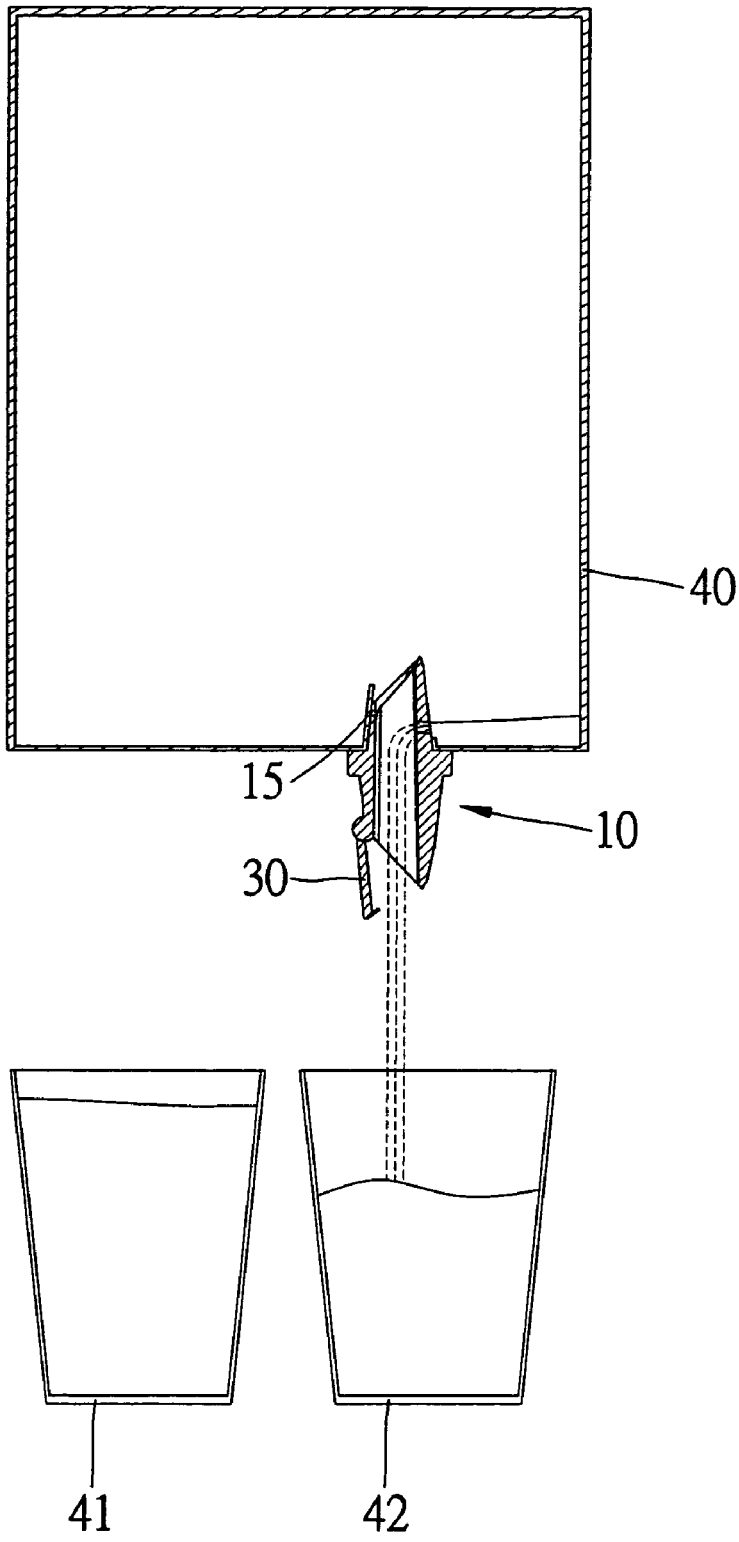

Referring to FIG. 10, as only a small amount of the beverage is left in the pack 40, the pack 40 is turned upside down so that the last amount of the beverage is poured into another cup 42 from the pack 40 through the spout and opener 10. At this instant, the last amount of the beverage flows through the slot 16.

The present invention has been described via detailed illustration of the preferred embodiment. Those skilled in the art can derive variations from the preferred embodiment without departing from the scope of the present invention. Therefore, the preferred embodiment shall not limit the scope of the present invention as defined in the claims.

What is claimed is:

1. A spout and opener comprising an opener portion with a sharp tip for opening a pack and receiving liquid from the pack, a spout portion for pouring the liquid to the exterior of the pack from the opener portion and a stop extending between the spout portion and the opener portion for avoiding insertion of the whole spout and opener into the pack, wherein said opener portion is contoured with an external perimeter thereof increasing continuously from the sharp tip to said stop in order to attain an increasingly tight engagement between said opener portion and said pack.

2. The spout and opener according to claim 1 wherein the opener portion comprises a cutout defined in an edge thereof.

3. The spout and opener according to claim 1 wherein the opener portion comprises a slot defined therein.

4. A dispensing apparatus comprising:

a spout and opener comprising an opener portion with a sharp tip for opening a pack and receiving liquid from the pack, a spout portion for pouring the liquid to the exterior of the pack from the opener portion and a stop extending between the spout portion and the opener portion for avoiding insertion of the whole spout and opener into the pack, wherein the opener portion gets thicker and thicker from the sharp tip in order to fit into the pack tighter and tighter;

a cap for capping the opener portion; and a cover for covering the spout portion;

wherein the stop defines a slot, and wherein the cap includes a tab extending into the slot from an end thereof, thus keeping the cap on the opener portion.

5. The dispensing apparatus according to claim 4 wherein the cover is pivotally connected with the spout portion.

6. The dispensing apparatus according to claim 5 wherein the cover comprises two ears pivotally connected with the spout portion.

7. The dispensing apparatus according to claim 6 wherein the spout portion comprises two recesses defined therein, wherein each of the ears comprises a boss formed thereon and put in related one of the recesses of the spout portion.

8. The dispensing apparatus according to claim 6 wherein the spout portion comprises two bosses formed thereon, wherein each of the ears comprises a recess defined therein for receiving related one of the bosses of the spout portion.

9. The dispensing apparatus according to claim 5 wherein the cover includes a hook for hooking the spout portion.

10. The dispensing apparatus according to claim 4 wherein the opener portion comprises a cutout defined in an edge thereof.

11. The dispensing apparatus according to claim 4 wherein the opener portion comprises a slot defined therein.

* * * * *